US005700582A

United States Patent [19]

Sargeant et al.

[11] Patent Number: 5,700,582

[45] Date of Patent: Dec. 23, 1997

[54] POLYMER MATRIX COATING FOR INK JET MEDIA

[75] Inventors: Steven J. Sargeant, West Warwick, R.I.; Niall D. Behan, Limerick, Ireland; Dave Atherton, Saunderstown; Sen Yang, Warwick, both of R.I.; Miaoling Huang, Danielson, Conn.; Kang Sun, North Attleboro, Mass.

[73] Assignee: Arkwright, Incorporated, Fiskeville, R.I.

[21] Appl. No.: 623,102

[22] Filed: Mar. 28, 1996

Related U.S. Application Data

[63] Continuation-in-part of Ser. No. 354,909, Dec. 12, 1994, abandoned.

[51] Int. Cl.[6] ..... B41J 2/01; B41M 5/00

[52] U.S. Cl. ..... 420/476.6; 428/195; 428/211; 428/325; 428/327; 428/328; 428/329; 428/330; 428/331; 428/500; 428/520; 428/522; 428/532

[58] Field of Search ..... 428/195.4, 478.2, 428/479.6, 500, 520, 522, 211, 325, 327–331, 476.6, 532

[56] References Cited

U.S. PATENT DOCUMENTS

| | | |
|---|---|---|
| 4,857,386 | 8/1989 | Butters et al. . |
| 5,134,198 | 7/1992 | Stofko, Jr. et al. . |
| 5,190,805 | 3/1993 | Atherton et al. . |
| 5,192,617 | 3/1993 | Stofko, Jr. et al. . |
| 5,208,092 | 5/1993 | Iqbal . |

FOREIGN PATENT DOCUMENTS

| | | |
|---|---|---|
| 0469595 | 2/1992 | European Pat. Off. . |
| 0482835 | 4/1992 | European Pat. Off. . |
| 0484016 | 5/1992 | European Pat. Off. . |
| 0487350 | 5/1992 | European Pat. Off. . |
| 0565154 | 10/1993 | European Pat. Off. . |
| 0594896 | 5/1994 | European Pat. Off. . |
| 9207722 | 5/1992 | WIPO . |

*Primary Examiner*—Pamela R. Schwartz

*Attorney, Agent, or Firm*—Birch, Stewart, Kolasch & Birch, LLP

[57] ABSTRACT

The present invention is directed to a polymer matrix coating used for ink jet recording media. The polymer matrix coating has a glass transition temperature that is greater than or equal to about 120° C. and less than or equal to about 300° C., an integrity value of greater than or equal to about −20% and a swellability of greater than or equal to about 50%. The coating avoids the problem of pigment ink cracking that can occur in conventional ink jet recording media.

20 Claims, No Drawings

POLYMER MATRIX COATING FOR INK JET MEDIA

The present application is a continuation-in-part of U.S. patent application Ser. No. 08/354,909, filed on Dec. 12, 1994, now abandoned, which said application is incorporated herein by reference in its entirety.

FIELD OF THE INVENTION

This invention relates to a polymer matrix coating, and more particularly to a polymer matrix coating that can be used for ink jet media that receive pigmented inks.

BACKGROUND OF THE INVENTION

Recently, pigmented inks have been used for ink jet printing to enhance density, color fidelity and reduce color fade. For example, such an ink has been used with a Hewlett-Packard DeskJet 1200C printer and gave excellent ink jet print quality. However, pigmented inks present a challenge for ink jet media development due to pigmented ink cracking. In this regard, such cracking reduces optical density and image resolution. There is an urgent need to have an ink jet medium that can be used with pigmented inks, while avoiding the problem of pigmented ink cracking.

SUMMARY OF THE INVENTION

An object of the present invention is to provide a polymeric matrix coating that can be used for ink jet media. Another object of the present invention is to provide a polymer matrix coating that can reduce or eliminate pigmented ink cracking problems, and at the same time give excellent optical density and image resolution when used for ink jet media.

Accordingly, the invention provides a polymer matrix coating that meets the above objects and which can be used in an ink jet media for receiving a pigmented ink. More specifically, the present invention provides an ink jet media which comprises an ink receiving polymeric matrix coating that possesses:

a glass transition temperature (Tg) greater than or equal to about 120° C. (preferably greater than or equal to about 130° C.) and less than or equal to about 300° C. (preferably less than or equal to about 260° C.), an integrity value of greater than or equal to about −20% (preferably greater than or equal to about −10%) as calculated using the integrity value % equation set forth herein, and a swellability of greater than or equal to about 50% (preferably greater than or equal to about 100%) as calculated using the swellability % equation set forth herein.

DETAILED DESCRIPTION OF THE INVENTION

The following Detailed Description (including the Examples set forth) is provided as an aid to those desiring to practice the present invention. It is not to be construed as being unduly limiting to the present inventive discovery, since those of ordinary skill in the art will readily recognize that the embodiments of the Inventors' discovery disclosed herein may be modified using standard techniques and materials known in the art, without departing from the spirit or scope of the present inventive discovery.

The polymer matrix coatings provided to ink jet films according to the present invention can be either single-layer or multi-layer structures. In either case, the polymer matrix coatings contain at least one water-soluble component. The water-soluble component of the polymer matrix provides ink sorptivity to the polymeric matrix. The water-soluble component can reside in any layer of the provided polymer matrix coatings.

Typically, suitable water-soluble components which may be used in the polymeric matrix coatings of the inventive ink jet films should be soluble in water in an amount of about at least 1% (preferably in an amount of about at least 3%), on a wt/wt basis of the water-soluble component in water at a temperature in the range of about 5° C. to about 100° C. Preferably, the water-soluble component is a component of a polymer. Exemplary of such water-soluble components are the following: poly(vinyl alcohol), cellulose ethers, cellulose esters, poly(vinyl pyrrolidone), gelatins, poly(vinyl acetate), starch, poly(acrylic acids), poly(ethylene oxide), proteins, hydroxypropyl cyclodextrin, poly(2-ethyl-2-oxazoline), alginates, and water-soluble gums, and the like.

The polymer matrix coating may optionally also contain water-insoluble components. Preferably, such water-insoluble components are components of a polymer. The water-insoluble components, when present, are employed to adjust the coating solubility, coating swellability, coating strength, coating flexibility, coating tackiness, etc. Exemplary of such water-insoluble components are 2-hydroxyethyl methacrylate, hydroxypropyl methacrylate, 2,3-dihydroxypropyl methacrylate, styrene, 5-hydroxy-3-oxapentyl methacrylate, 8-hydroxy-3,6-dioxaoctyl methacrylate, N-hydroxyethyl acrylamide, urethane, N-hydroxymethyl acrylamide, dimethylaminoethyl methacrylate, alkyl methacrylate, N-methyloacrylamide and hydroxypropyl acrylate, and the like. Typical water-insoluble components can also include crosslinked derivatives of water-soluble components like those described above.

Both the water-soluble and optional water-insoluble components that can be used in the inventive ink jet media herein disclosed can be in the form of a monomer, an oligomer, a homopolymer, a copolymer or a polymer blend, provided that they otherwise meet the parameters set forth herein.

The drying process of a pigmented ink when applied to a polymeric coating of an ink jet media is complicated. First, the polymer coating absorbs the ink vehicle and swells. Then, as the ink vehicle evaporates, the polymer coating shrinks. This deformation of the polymer coating can cause the pigmented ink to crack. The cracking is observed as a non-uniform distribution of the pigmented ink on the coating surface as well as a reduced optical density. Voids are usually also observed on the cracked ink surface. To avoid pigmented ink cracking, the Inventors have discovered that the integrity and rigidness of the polymeric coating must be preserved during printing. In this regard, the Inventors have also discovered that the relatively tough polymer matrix coatings provided herein are capable of maintaining their integrity and rigidness during printing and are capable of reducing or eliminating pigmented ink cracking.

Since the glass transition temperature (Tg) of a polymer can be used as an indicator of the polymer's structure, the present Inventors deduced that the structure of a polymeric matrix coating could also be probed by its glass transition temperature, and that a polymeric matrix's Tg, or multiple Tg's, could even be used as a criteria for achieving a suitable polymer matrix coating design. For example, a high glass transition temperature implies a compact and rigid polymer structure, while a low glass transition temperature implies an open and flexible polymer structure. To resist ink vehicle attack and sustain volume change upon printing, the Inventors discovered that at least one polymeric matrix coating layer having a Tg that is greater than or equal to about 120° C. (preferably greater than or equal to about 130° C.) and less than or equal to about 300° C. (preferably less than or equal to about 260° C.), should be present in their inventive ink jet media, if the objects of the invention are to be met. This also implied that for copolymer and polymer blends that contain copolymers and/or polymers that are not 100% compatible, and thus which blends possess more than one Tg, at least one of the Tg's of such blends should be greater than or equal to about 120° C. (preferably greater than or equal to about 130° C.) and less than or equal to about 300° C. (preferably less than or equal to about 260° C.), in the inventive ink jet media.

Glass transition temperatures are measured on a Differential Scanning Calorimeter (TA Instruments, Model DC 2910), calibrated with appropriate standards. Using such an instrument, the reading and baseline errors from replicate DSC experiments lead to a typical accuracy in measuring Tg of about 3° C. Measurements of heat flow versus temperature are made upon heating in the range of about 40° to 2000° C. at a heating rate of 10° C./minute. The sample chamber is purged with dry nitrogen. Film-like samples are encapsulated in an aluminum pan. The midpoint method (i.e., identification of the maximum of the derivative of heat flow versus temperature curve) is used to obtain Tg data from the measured DSC curve.

The structures of the polymer matrix coating layers present in the Inventor's ink jet media can also be probed according to their integrity values. An integrity value indicates the degree that a polymer coating maintains its integrity in water. The integrity value can be either positive or negative. A negative value indicates that a dissolution of the polymer coating occurs in water. Integrity values are measured according to the following procedure. A sample (approximately 2"×1") of a polymer matrix coating is weighed and then immersed in water (about 25° C.) for about 15 seconds. The excess water on the surface of the sample is then removed by blotting the surface with a XEROX® 4200 paper. The sample is then weighed again. The same sample is re-immersed in water for an additional 45 seconds. Then the same blotting and weighing procedures are again followed. The integrity value is then calculated as expressed below:

$$\text{Integrity value (\%)} = [(W_{60} - W_{15})/W_{15}] \times 100\%$$

wherein, $W_{60}$ is the weight at 60 seconds immersion, and $W_{15}$ is the weight at 15 seconds immersion.

To resist ink vehicle attack and sustain volume change upon printing, the Inventors have discovered that at least one of the polymer matrix coating layers in their inventive media should have an integrity value of greater than or equal to about −20% (preferably greater than or equal to about −10%) as measured using the above test procedure.

The polymer matrix coating disclosed in the present invention should be swellable in water at about 25° C. The swellability of the coating is measured according to the following procedure. A sample (approximately 2"×1") of a polymer matrix coating is weighed and then immersed in water for about 60 seconds. The excess water on the surface of the sample is then removed by blotting the surface with a XEROX® 4200 paper. The sample is then weighed again. The swellability of the coating is calculated as expressed below:

$$\text{Swellability (\%)} = \frac{W_{60} - W_0}{W_0} \times 100$$

wherein $W_{60}$ is the weight at 60 seconds immersion, and wherein $W_0$ is the weight before immersion.

The swellability of the polymer matrix coatings of the present invention should be greater than or equal to about 50% (preferably greater than or equal to about 100%).

It is also thought important that the provided polymer matrix coatings be imageable or have an acceptable image quality. Accordingly, the polymer matrix coatings should be able to receive ink and form images. Preferably, the optical density of a black color image should be greater than or equal to about 1.70 (preferably greater than or equal to about 1.80) on a transparency substrate having coated on a surface thereof a polymeric matrix coating as provided for herein. The optical density is preferably measured on a Macbeth TD904 Densitomer using a beige filter setting and a 4 mm aperture, with the final density reading being an average of at least three readings.

In order to prepare an ink jet media encompassed hereby, the polymer matrix coatings disclosed herein can be applied to any suitable base substrate generally used to prepare an ink jet media. Exemplary of such base substrates are transparent plastics, translucent plastics, matte plastics, opaque plastics or papers. Furthermore, suitable polymeric materials for use in such base substrates include polyester, cellulose esters, polystyrene, polypropylene, poly(vinyl acetate), polycarbonate, and the like. Poly(ethylene terephthalate) films are thought to be particularly preferred as base substrates. Further, while almost any paper can be used as a base substrate, clay coated papers are particularly preferred as base substrate papers. The thickness of the base substrate is not particularly restricted, but should generally be in the range of from about 1 to about 10 mils (preferably from about 3.0 to about 5.0 mils). The base substrate may be pretreated to enhance the adhesion of coatings thereto.

According to a preferred embodiment of the invention, the polymer matrix coatings encompassed by the present invention additionally contain about 0.1 to about 15 wt/wt % of particulate(s) based on the weight of the dry coatings. The particulate(s) can be used in the polymeric matrix coatings to modify the properties of the coatings, and include inorganic particulates, such as silica, alumina, kaolin, glass beads, calcium carbonate and titanium oxide, as well as organic particulates such as polyolefins, polystyrene, starch, poly(methyl methacrylate), poly(urethane) and polytetrafluoroethylene.

In practice, various additives may also be employed in the disclosed polymeric matrix coatings, if so desired. These additives can include surface active agents which control the wetting or spreading action of coating solutions, antistatic agents, suspending agents, and acidic compounds to control the coatings' pH values. Other art recognized and conventional additives may also be used if so desired.

The surface of the base substrate which does not bear the polymer matrix coating may have a backing material placed thereon in order to reduce electrostatic charge and to reduce sheet-to-sheet friction and sticking, if so desired. The backing material may be either be a polymeric coating, a polymer film or paper.

Any of a number of coating methods may be employed to coat the polymer matrix onto the substrates. Methods such as roller coating, blade coating, wire-bar coating, dip coating, extrusion coating, air knife coating, curtain coating, slide coating, doctor coating or gravure coating, may be used and are well known in the art.

The following examples are given merely as illustrative of the invention and are not to be considered as limiting to the present inventive discovery. In the following Examples, the solid content for the listed ingredients is provided based on a part/part (wt/wt) basis.

EXAMPLE I

A coating composition is prepared according to the following formulation:

| Polymer matrix coating: | |
|---|---|
| PVP K90[1] | 18 parts |
| Copolymer A[2] | 16 parts |
| Methyl Ethyl Ketone | 86 parts |
| Propylene Glycol Monomethyl Ether | 25 parts |

[1]Poly(vinyl pyrrolidone), ISP Corporation
[2]A Copolymer of methyl methacrylate and hydroxyethyl methacrylate The coating is applied to a polyester film (ICI Films) using a No. 54 Meyer rod. The polymer matrix coating is dried at about 130° C. for about 2 minutes.

EXAMPLE II

A coating composition is prepared according to the following formulation:

| Polymer matrix coating: | |
|---|---|
| PVP K120[1] | 19 parts |
| Poly (methyl methacrylate)[2] | 6 parts |
| Methyl Ethyl Ketone | 106 parts |
| Propylene Glycol Monomethyl Ether | 70 parts |

[1]Poly(vinyl pyrrolidone), ISP Corporation
[2]Rohm and Hass Corporation

The coating is applied to a polyester film (ICI Films) using a No. 54 Meyer rod. The polymer matrix coating is dried at about 130° C. for about 2 minutes.

EXAMPLE III

A coating composition is prepared according to the following formulation:

| Polymer matrix coating: | |
|---|---|
| Hydroxypropyl methylcellulose[1] | 4.5 parts |
| Poly(vinyl pyrrolidone)[2] | 0.5 parts |
| Water | 95 parts |

[1]Dow Chemical Corporation
[2]ISP Corporation

The coating is applied to a polyester film (ICI film) using a No. 60 Meyer road. The polymer matrix coating is dried at about 130° C. for about 2 minutes.

COMPARATIVE EXAMPLE I

A coating composition is prepared according to the following formulation:

| | |
|---|---|
| PVP K90 | 15 parts |
| Methyl Ethyl Ketone | 60 parts |
| Propylene Glycol Monomethyl Ether | 25 parts |

The coating is applied to a polyester film (ICI Film) using a No. 54 Meyer rod. The polymer matrix coating is dried at about 130° C. for about 2 minutes.

COMPARATIVE EXAMPLE II

A coating composition is prepared according to the following formulation:

| Polymer matrix coating: | |
|---|---|
| PVP K90 | 12 parts |
| Copolymer A | 4 parts |
| Glyceryl Triacetate[1] | 3 parts |
| Methyl Ethyl Ketone | 51 parts |
| Propylene Glycol Monomethyl Ether | 34 parts |

[1]Eastman Chemical Corporation

The coating is applied to a polyester film (ICI Films) using a No. 54 Meyer rod. The polymer matrix coating is dried at 130° C. for about 2 minutes.

COMPARATIVE EXAMPLE III

XEROX® ink jet transparency film (3R3351, Lot number XRCCDPB90-808-01).

Pigmented ink cracking is evaluated for the above Examples on a Hewlett Packard DeskJet 1200C printer using an HP 51640A ink cartridge.

Glass transition temperatures (Tg), integrity values and ink cracking measurements of the polymer matrix coatings in the above Examples are presented in Table I. The pigmented ink cracking is quantitatively rated in Table I with a numerical scale (0=worst and 5=best). When ink cracking is rated below 3, visible ink cracking is observed and the ink jet media are not deemed suitable for many commercial applications.

TABLE I

Glass Transition Temperature[1] Integrity Value and Ink Cracking

| Example | Tg (°C.) | Integrity Value (%) | Ink Cracking |
|---|---|---|---|
| I | 165 | 7 | 4 |
| II | 167 | 8 | 5 |
| III | 167 | 14 | 5 |
| CI | 162 | −71 | 0 |
| CII | 92 | 3 | 2 |
| CIII | 142 | −76 | 2 |

The above results show that the presently disclosed inventive ink jet media exhibit a large advantage in avoiding pigmented ink cracking, when compared with the comparative ink jet media Examples CI–CIII having either Tg or integrity values falling outside those required in the present invention. Specifically, in Examples CI and CIII, the measured integrity values were less than those provided for in the present inventive media, and in Example CII, the measured Tg value was less than that provided for in the present inventive media.

It is noted that while ink cracking is evaluated in the above Examples on a Hewlett Packard Deskjet 1200C, pigmented ink cracking can also be, and preferably is, evaluated on the ink jet printer, plotter or copier used in the intended applications.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An ink jet recording medium, comprising a base substrate that has coated on a surface thereof a polymer matrix coating that can receive a pigmented ink and which contains at least one layer having a glass transition temperature that is greater than or equal to about 120° C. and less than or equal to about 300° C., an integrity value greater than or equal to about −20% and a swellability greater than or equal to about 50%.

2. The ink jet recording medium according to claim 1, wherein said polymer matrix coating contains at least one water-soluble component.

3. The ink jet recording medium according to claim 2, wherein said water-soluble component is soluble in water in an amount of about at least 1% on a wt/wt basis at a temperature in the range of about 5° C. to about 100° C.

4. The ink jet recording medium according to claim 2, wherein said water-soluble component is selected from the group consisting of poly(vinyl alcohol), cellulose ethers, cellulose esters, poly(vinyl pyrrolidone), gelatins, poly (vinyl acetate), starch, poly(acrylic acids), poly(ethylene oxide), proteins, hydroxypropyl cyclodextrin, poly(2-ethyl-2-oxazoline), alginates and water-soluble gums.

5. The ink jet recording medium according to claim 1, wherein said polymer matrix coating contains at least one water-soluble component and at least one water-insoluble component.

6. The ink jet recording medium according to claim 5, wherein:

said water-soluble component is soluble in water in an amount of about at least 1% on a wt/wt basis of the water-soluble component in water at a temperature in the range of about 5° C. to about 100° C.

7. The ink jet recording medium according to claim 5, wherein said water-soluble component is selected from the group consisting of poly(vinyl alcohol), cellulose ethers, cellulose esters, poly(vinyl pyrrolidone), gelatins, poly (vinyl acetate), starch, poly(acrylic acids), poly(ethylene oxide), proteins, hydroxypropyl cyclodextrin, poly(2-ethyl-2-oxazoline), alginates and water-soluble gums.

8. The ink jet recording medium according to claim 5, wherein said water-insoluble component is selected from the group consisting of 2-hydroxyethyl methacrylate, hydroxypropyl methacrylate, 2,3-dihydroxypropyl methacrylate, styrene, 5-hydroxy-3-oxapentyl methacrylate, 8-hydroxy-3, 6-dioxaoctyl methacrylate, N-hydroxyethyl acrylamide, urethane, N-hydroxymethyl acrylamide, dimethylaminoethyl methacrylate, alkyl methacrylate, N-methyloacrylamide and hydroxypropyl acrylate.

9. The ink jet recording medium according to claim 1, wherein said polymer matrix coating possesses a single layer structure.

10. The ink jet recording medium according to claim 1, wherein said polymer matrix coating possesses a multi-layer structure.

11. The ink jet recording medium according to claim 1, wherein said polymer matrix coating upon receiving a pigmented ink gives a black image optical density of greater than or equal to about 1.70 on a transparent substrate.

12. The ink jet recording medium according to claim 1, wherein said polymer matrix coating possesses multiple glass transition temperatures and wherein at least one of said glass transition temperatures is greater than or equal to about 120° C. and less than or equal to about 300° C.

13. The ink jet recording medium according to claim 1, wherein said polymer matrix coating comprises inorganic particulates which are selected from the group consisting of silica, alumina, kaolin, glass beads, calcium carbonate and titanium oxide.

14. The ink jet recording medium according to claim 1, wherein said polymer matrix coating comprises organic particulates which are selected from the group consisting of polyolefins, polystyrene, starch, poly(methyl methacrylate), poly(urethane), and polytetrafluoroethylene.

15. The ink jet recording medium according to claim 1, wherein said base substrate is a transparent plastic, a translucent plastic, a matte plastic or an opaque plastic.

16. The ink jet recording medium according to claim 1, wherein said base substrate is a poly(ethylene terephthalate) film.

17. The ink jet recording medium according to claim 1, wherein said base substrate is a paper.

18. The ink jet recording medium according to claim 1, wherein said base substrate is a clay coated paper or a polyolefin coated paper.

19. An ink jet recording medium, comprising a base substrate that has coated on a surface thereof a polymer matrix coating that can receive a pigmented ink and which contains at least one layer having a glass transition temperature that is greater than or equal to about 120° C. and less than or equal to about 300° C., an integrity value greater than or equal to about −20%, and a swellability greater than or equal to about 50%; and said polymer matrix coating comprising a water-soluble component which is soluble in water in an amount of about at least 1% on a wt/wt basis of the water-soluble component in water at a temperature in the range of about 5° C. to about 100° C.

20. An ink jet recording medium, comprising a base substrate that has coated on a surface thereof a polymer matrix coating that can receive a pigmented ink and which contains at least one layer having a glass transition temperature that is greater than or equal to about 120° C. and less than or equal to about 300° C., an integrity value greater than or equal to about −20%, and a swellability greater than or equal to about 50%; and said polymer matrix coating comprising a water-soluble component which is soluble in water in an amount of about at least 1% on a wt/wt basis of the water-soluble component in water at a temperature in the range of about 5° C. to about 100° C., and a water-insoluble component.

* * * * *